US006450767B2

(12) United States Patent
Nantt et al.

(10) Patent No.: US 6,450,767 B2
(45) Date of Patent: Sep. 17, 2002

(54) RADIAL BLOWER

(75) Inventors: Wolfgang Nantt, Steinheim; Igor Klaric, Korb; Christoph von Hiller, Stuttgart, all of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/733,047

(22) Filed: Dec. 11, 2000

(30) Foreign Application Priority Data

Dec. 9, 1999 (DE) ..... 199 59 344

(51) Int. Cl.[7] ..... F04D 29/02

(52) U.S. Cl. ..... 415/197; 415/200; 415/206; 415/214.1; 415/915

(58) Field of Search ..... 415/196, 197, 415/204, 206, 212.1, 200, 214.1, 173.1, 173.4, 915

(56) References Cited

U.S. PATENT DOCUMENTS 1,271,072 A * 7/1918 Parsons ..... 415/217.1
3,019,963 A * 2/1962 Eck ..... 415/204
3,689,931 A * 9/1972 Fortis ..... 415/202
4,419,048 A * 12/1983 Pilachowski et al. ..... 415/196
4,595,318 A * 6/1986 Viesselmann ..... 416/97
4,872,809 A * 10/1989 Addie et al. ..... 415/206
4,884,946 A * 12/1989 Belanger et al. ..... 415/206
4,974,998 A * 12/1990 Heineman ..... 406/97
5,281,092 A * 1/1994 Sullivan ..... 415/206
5,839,879 A * 11/1998 Kameoka et al. ..... 415/206
6,161,514 A * 12/2000 Ernst et al. ..... 123/188.47
6,210,109 B1 * 4/2001 Will et al. ..... 415/204

* cited by examiner

*Primary Examiner*—Edward K. Look
*Assistant Examiner*—Richard A. Edgar
(74) *Attorney, Agent, or Firm*—Walter Ottesen

(57) ABSTRACT

The invention relates to a radial blower for a work apparatus and especially for a suction/blower apparatus. The radial blower has a blower wheel (2) and a blower housing (1) which at least partially surrounds the blower wheel (2). The blower housing (1) includes a peripheral wall (3) and a side wall (4). The housing includes an intake opening (6) in the region of the blower wheel axis (5) as well as a discharge stub (7) peripherally of the blower wheel (2) in the region of the peripheral wall (3). The peripheral wall (3) and the side wall (4) are lined on the side facing toward the blower wheel (2) with a wear insert (8) configured as one piece.

16 Claims, 3 Drawing Sheets

RADIAL BLOWER

FIELD OF THE INVENTION

The invention relates to a radial blower for a work apparatus, especially for a suction/blower apparatus.

BACKGROUND OF THE INVENTION

Radial blowers of the above kind draw air by suction through an end face intake opening, which is arranged in the region of the rotational axis of the blower wheel, and accelerate this air radially and tangentially outwardly via the blower wheel. The air is accelerated along an essentially spirally shaped running path because of the peripheral wall of the blower housing and is discharged from the blower housing via a peripheral discharge stub aligned approximately tangentially.

In practice, work apparatus with such radial blowers are operated under ambient conditions which are greatly laden with dirt, for example, for cutoff machines or chain saws having a radial cooling blower and especially for a suction/blower apparatus having a radial blower whose air flow intensely entrains dirt particles, dust grains, or sand grains, et cetera. The dirt particles likewise reach a considerable velocity during the acceleration operation and rub against the side and peripheral inner walls of the blower housing with a considerable level of energy. The entrained dirt particles have a considerably higher specific weight than air. For this reason, these dirt particles impinge with a velocity component, which is directed normally to the surface of the peripheral wall, against the inner side of the peripheral wall. This impact operation as well as the rubbing of the dirt particles against the inner walls can lead to a considerable wear of the blower housing.

Configuring the blower housing with thicker walls in the wear-endangered regions makes the component heavy and difficult to manipulate. A material selection, which corresponds to the requirements of the wear protection for the blower housing, compels a critical compromise between manipulability, weight and material strength.

SUMMARY OF THE INVENTION

It is an object of the invention to further improve a radial blower in such a manner that it has an increased resistance against wear with simple means and a cost-effective use of material.

The radial blower of the invention is for a work apparatus including a suction/blower apparatus and includes: a blower wheel defining a periphery; a blower housing at least partially enclosing the blower wheel; the blower housing having a peripheral wall and a side wall; the side wall having an intake opening; the blower housing further having a discharge stub arranged in the region of the peripheral wall opposite the periphery of the blower wheel; the peripheral wall and the side wall conjointly defining a wall surface facing toward the blower wheel; and, the wall surface being lined with a wear insert configured as one piece.

A functional separation of the blower housing from the surface, which is subjected to wear, is achieved with the arrangement of a separate wear insert in the blower housing. In this way, both components can be correspondingly optimized to the requirements especially with respect to the selection of materials therefor. In this way, the blower housing can therefore be configured to be thin-walled and therefore light, for example, from a stiff, strong and cold-flexible material and, in this way, the blower housing can serve as a carrier for a wear insert optimized as to wear strength. Abutting edges are avoided by making the wear insert as one piece. Otherwise, dirt can deposit between such abutting edges. It is also avoided that dirt particles become lodged between the wear insert and the blower housing which would otherwise lead to a lifting of the wear insert from the blower housing. By making the wear insert as one piece, there further results a configuration of the wear insert which leads to a form-tight fit with the blower housing and this contributes to a close bond of both components.

The dirt particles can be propelled far into the discharge stub because of their combined radial and tangential path. For this reason, the wear insert preferably extends into the discharge stub. The discharge edge is formed between the discharge stub and the peripheral wall close to the blower wheel. This discharge edge is purposefully configured so as to be rounded and is additionally protected by a strengthening of the wear insert in this region.

By configuring the blower housing from two half shells, the partition plane of the two half shells forms a partition line along which also a free edge of the wear insert runs. The two half shells are preferably so configured that the partition plane lies perpendicularly to the blower axis. In this way, the partition plane can be constructively so placed that the sensitive peripheral free edge of the wear insert lies outside of the peripheral region of the blower wheel and therefore outside of the direct impact caused by free flying dirt particles. In this way, other requirements can be considered also, such as easy assembly. Even if the partition line should lie in the peripheral region of the blower wheel, it is ensured that the free edge of the wear insert does not lie perpendicularly to the tangentially running fly path of the dirt particles. In this way, it is ensured that the dirt particles, which fly with high kinetic energy, cannot deposit between the wear insert and the blower housing.

A further free edge of the wear insert lies in the region of the side wall annularly about the intake opening. To protect this free edge, a shoulder is provided in the side wall and this shoulder rises in the axial direction. This shoulder forms an approximately circularly-shaped concave edge and an approximately circularly-shaped convex edge in the side wall. The wear insert extends in the radial direction from the peripheral wall and along the side wall around the convex edge and over the shoulder and into the concave edge. The free edge of the wear insert is well protected in the concave edge against direct impact of high-energy particles. The convex edge is preferably configured so as to be rounded whereby a reduced flow resistance can be achieved.

The permanence of form and the general ability of the blower housing to withstand load under various conditions is ensured by an embodiment in preferably injection-molded plastic and especially in glass-fiber reinforced polyamide. The wear insert is purposefully formed of an elastic plastic, rubber or a rubber mixture especially in the bond to a blower housing of this type of configuration whereby a high resistance to wear and high impact damping can be achieved.

A permanent bond of the wear insert to the blower housing can be achieved in that both parts form a surface melt bond with each other. In this way, an adherence strength between the two parts can be achieved which can even lie above the material strength of the wear insert. In this way, it is achieved that the resistance to wear is determined alone by the material characteristics of the wear insert without having to accept a premature failure by separation of the wear insert from the apparatus housing.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
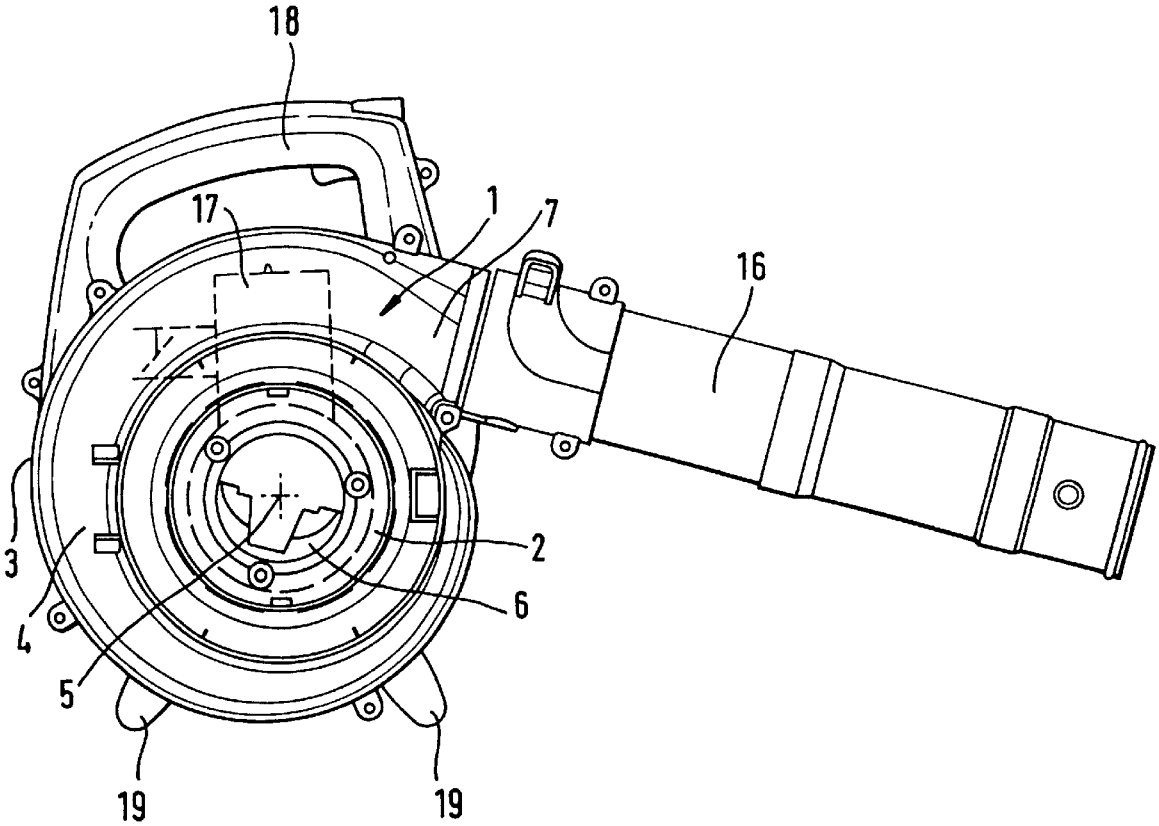
FIG. 1 is a schematic representation of a suction/blower apparatus having a radial blower.

The suction/blower apparatus shown in FIG. 1 includes a radial blower having a spirally-shaped blower housing 1 wherein a blower wheel 2 is mounted. The blower is driven by an internal combustion engine 17 and the blower wheel 2 is rotatable about the blower wheel axis 5. The blower housing 1 includes a side wall 4 and a peripheral wall 3. An intake opening 6 for inducting air is provided in the side wall 4 in the region of the blower wheel axis 5.

In the region of the peripheral wall 3, the blower housing 1 includes a tangentially disposed discharge stub 7 on which a blower tube 16 is attached for discharging the air inducted through the intake opening 6. A handle 18 for carrying and operating the apparatus is provided on the periphery of the blower housing 1 in the region of the discharge stub 7. Two feet 19 for setting the apparatus down are arranged on the opposite-lying side.

Figure 2:
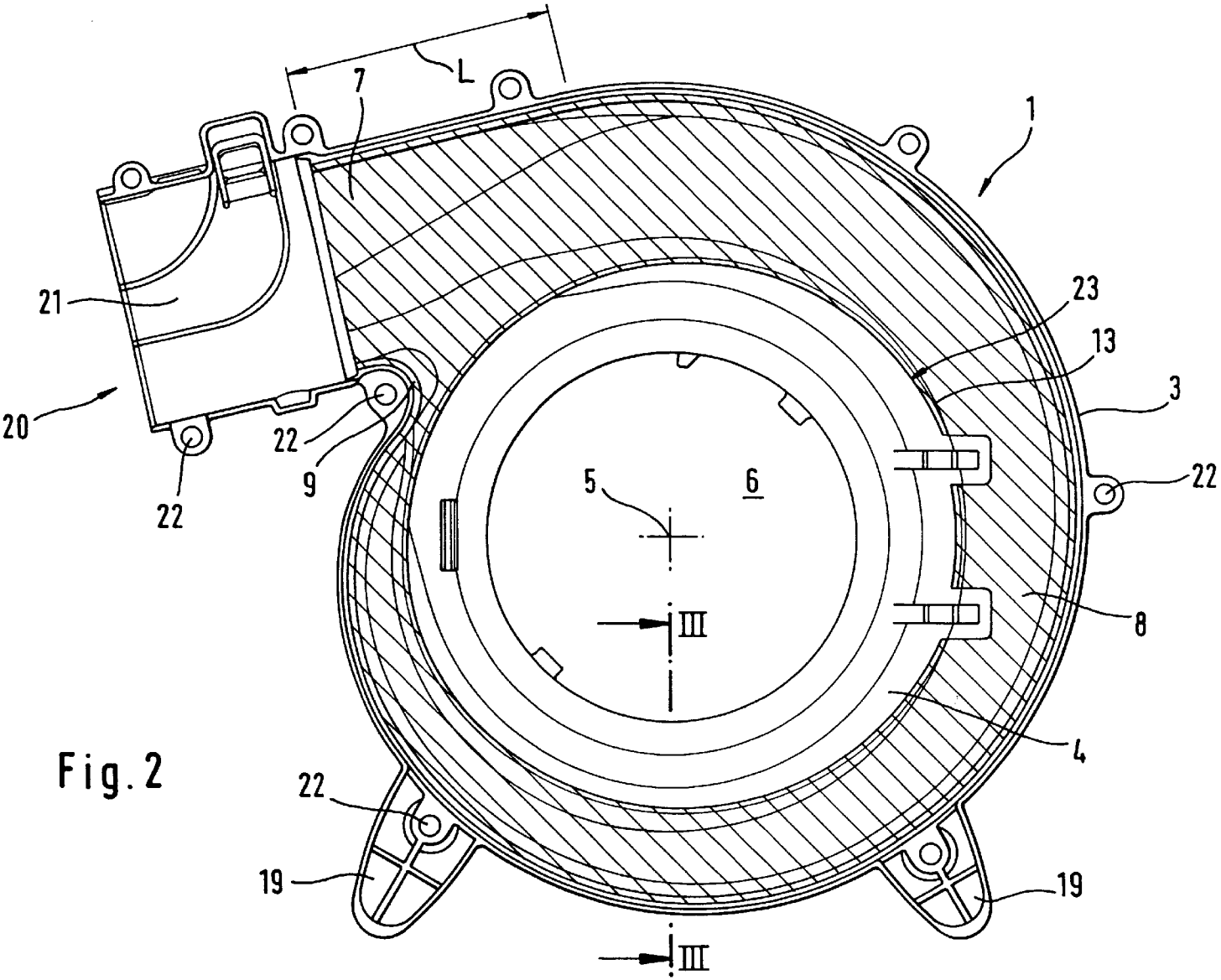
FIG. 2 is an inner view of the housing of the radial blower of FIG. 1; and, FIG. 3 is a detail section of the blower housing taken along line III—III of FIG. 2.

FIG. 2 shows an inner view of the radial housing of FIG. 1. The blower wheel is not shown in FIG. 2 to provide better clarity. The side wall 4 of the blower housing 1 includes an intake opening 6 in the region of the blower wheel axis 5. The intake opening is configured so as to have a circular shape in the embodiment shown and is arranged concentric to the blower wheel axis 5. The outer contour of the side wall 4 is configured so as to be spirally shaped and is delimited by a peripheral wall 3. The peripheral wall 3 is bent over perpendicularly to the side wall 4 and is shown in greater detail in FIG. 3. Two feet 19 as well as a plurality of screw mounts 22 are formed as one piece with the peripheral wall 3.

The discharge stub 7 is formed in the peripheral wall 3 on the peripheral side of the blower housing 1. A bayonet connection 21 is provided on the free end 20 of the discharge stub 7 for releasably attaching the blower tube 16 (FIG. 1). The discharge stub 7 together with the peripheral wall 3 forms an especially rounded discharge edge 9 on a side of the peripheral wall 3 facing toward the blower wheel axis 5.

Figure 3:
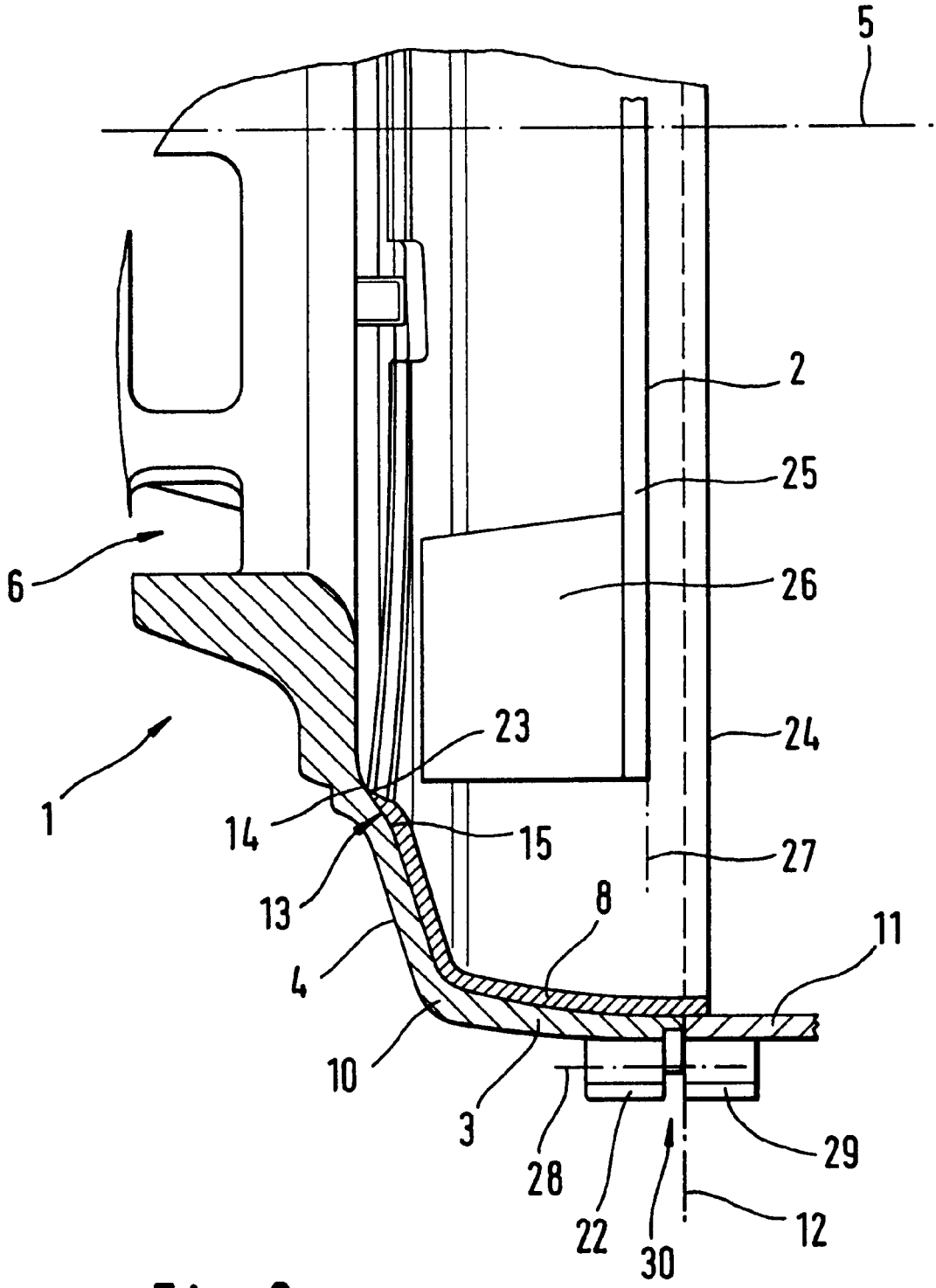

The side wall 4 includes a shoulder 13 which extends about the intake opening 6 as shown in greater detail in FIG. 3 and is configured approximately cylindrically. On its inner side in the region of the peripheral wall 3, the blower housing 1 and the side wall 4 are lined with a wear insert 8 configured as one piece and shown with hatching. The wear insert 8 extends in radial direction outside of the shoulder 13. In the region of the intake opening 6, the wear insert 8 is delimited by a radial inner free edge 23 which, in the embodiment shown, lies in the region of the shoulder 13 and is configured to have a taper. The wear insert 8 covers the rounded discharge edge 9 and projects over a defined length L into the discharge stub 7. The wear insert 8 is strengthened or reinforced in the region of the discharge edge 9. The reinforcement is provided, for example, with an increased thickness of material.

FIG. 3 provides a detail view of the radial blower in section taken along line III—III of FIG. 2. The blower housing 1 is formed by two half shells (10, 11) which are connected to each other via threaded fastener connections 30. For this purpose, the half shell 10 includes a plurality of screw mounts 22 into which screws 28 engage. The screws 28 are preferably self-cutting and have heads which are held in screw receptacles 29 arranged on the half shell 11. Clamps, snap connectors or the like can be provided in lieu of the screw connections 30.

The blower wheel 2 is rotatable about the blower wheel axis 5 in the blower housing 1. The blower wheel 2 is configured as a single-flow blower wheel, that is, blades 26 are mounted only on the side of the blower wheel plate 25 facing to the intake opening 6. An embodiment of the radial blower as a double-flow blower can also be purposeful.

The shoulder 13 in the side wall 4 rises in axial direction and is delimited by a concave rounded edge 14 and a convex rounded edge 15. The free edge 23 of the wear insert 8 lies in the concave edge 14 and runs out tapered into this edge so that the wear insert 8 extends, measured in radial direction, from the concave edge 14 over the shoulder 13 and around the convex edge 15 along the side wall 4 and over the peripheral wall 3. At the peripheral wall 3, the wear insert 8 is delimited by an axially, annularly extending free edge 24.

The two half shells (10, 11) are so configured that their partition plane 12 lies perpendicularly to the blower wheel axis 5. In the embodiment shown, the partition plane 12 lies on the side of the plate plane 27 which faces away from the intake opening 6. The plate plane 27 is formed by the blower wheel plate 25. In this way, the peripherally extending free edge 24 of the wear insert 8 is protected outside of the peripheral region of the blower wheel 2. The wear insert 8 overlaps the partition plane 12 in the region of its free edge 24 and thereby also works as a seal between the two half shells (10, 11). The half shell 11 can also be lined with a wear insert 8 in the manner shown for half shell 10 in an embodiment of the radial blower as a double-flow blower or with a partition plane 12 lying in the peripheral region of the blower wheel 2.

The two half shells (10, 11) of the blower housing 1 are manufactured of injection-molded, glass-fiber reinforced polyamide. The wear insert 8 comprises an elastic, rubber-like plastic and can be glued to the blower housing 1. As shown in the embodiment, it is preferable that the wear insert 8 is configured as quasi one piece with the blower housing via a surface-fused bond. The fused bond can be made by spraying on the wear insert while the blower housing is still warm. The wear insert made as a molded part comes into close snug contact against the blower housing and ensures a continuous lining in this manner. In this way, the possibility is provided to avoid material edges facing toward the air flow so that the dirt particles have no surface where they can accumulate.

It is understood that the foregoing description is that of the preferred embodiments of the invention and that various changes and modifications may be made thereto without departing from the spirit and scope of the invention as defined in the appended claims.

What is claimed is:

1. A radial blower for a work apparatus including a suction/blower apparatus, the radial blower comprising:

a blower wheel for moving air and said blower wheel defining a periphery;

a blower housing at least partially enclosing said blower wheel;

said blower housing having a peripheral wall and a side wall;

said side wall having an intake opening;

said blower housing further having a discharge stub arranged in the region of said peripheral wall opposite said periphery of said blower wheel;

said peripheral wall and said side wall conjointly defining a wall surface facing toward said blower wheel; and, said wall surface being lined with a wear insert configured as one piece.

2. The radial blower of claim 1, wherein said wear insert extends into said discharge stub a distance (L).

3. The radial blower of claim 1, wherein said wear insert extends over an annular surface of said side wall.

4. The radial blower of claim 3, wherein said wear insert also extends over the entire elevation of said peripheral wall.

5. The radial blower of claim 1, said blower wheel defining a rotational axis; and, said blower housing being formed of two half shells conjointly defining a partition plane perpendicular to said rotational axis.

6. The radial blower of claim 1, wherein said blower housing is made of an injection molded plastic.

7. The radial blower of claim 6, wherein said blower housing is made of glass fiber reinforced polyamide.

8. The radial blower of claim 1, wherein said wear insert is made of an elastic material.

9. The radial blower of claim 1, wherein said elastic material is made of at least one of plastic, rubber and a rubber mixture.

10. The radial blower of claim 1, wherein said blower housing and said wear insert conjointly define a surface-fused bond.

11. The radial blower of claim 10 wherein said blower housing is made of injection-molded plastic and said wear insert is made of at least one of plastic, rubber and a rubber mixture.

12. The radial blower of claim 1, wherein said one piece is a single homogeneous piece devoid of abutting edges.

13. A radial blower for a work apparatus including a suction/blower apparatus, the radial blower comprising:

a blower wheel defining a periphery;

a blower housing at least partially enclosing said blower wheel;

said blower housing having a peripheral wall and a side wall;

said side wall having an intake opening;

said blower housing further having a discharge stub arranged in the region of said peripheral wall opposite said periphery of said blower wheel;

said peripheral wall and said side wall conjointly defining a wall surface facing toward said blower wheel;

said wall surface being lined with a wear insert configured as one piece;

said discharge stub and said peripheral wall conjointly defining a discharge edge; and, said wear insert being strengthened in the region of said discharge edge.

14. The radial blower of claim 13, said discharge edge being a rounded edge.

15. A radial blower for a work apparatus including a suction/blower apparatus, the radial blower comprising:

a blower wheel defining a periphery;

a blower housing at least partially enclosing said blower wheel;

said blower housing having a peripheral wall and a side wall;

said side wall having an intake opening;

said blower housing further having a discharge stub arranged in the region of said peripheral wall opposite said periphery of said blower wheel;

said peripheral wall and said side wall conjointly defining a wall surface facing toward said blower wheel;

said wall surface being lined with a wear insert configured as one piece;

said side wall having a shoulder extending annularly around said intake opening;

said shoulder rising in axial direction and defining a concave edge and a convex edge; and, said wear insert extending from said concave edge over said shoulder and beyond said convex edge to said peripheral wall.

16. The radial blower of claim 15, wherein said convex edge is rounded.

* * * * *